US006142003A

United States Patent [19]

Plociennik et al.

[11] Patent Number: 6,142,003

[45] Date of Patent: Nov. 7, 2000

[54] METHOD AND APPARATUS FOR COOLING HOT-ROLLED ROLLING STOCK, PARTICULARLY HOT-ROLLED WIDE STRIP

[75] Inventors: Uwe Plociennik, Ratingen; Meinert Meyer, Erkrath; Ludwig Weingarten, Düsseldorf; Martin Braun, Kreuztal, all of Germany

[73] Assignee: SMS Schloemann-Siemag Aktiengesellschaft, Dusseldorf, Germany

[21] Appl. No.: 09/433,626

[22] Filed: Nov. 3, 1999

[30] Foreign Application Priority Data

Nov. 4, 1998 [DE] Germany ..... 198 50 739

[51] Int. Cl.[7] ..... B21B 27/06; B21B 28/00

[52] U.S. Cl. ..... 72/201; 72/236; 72/200

[58] Field of Search ..... 72/200, 201, 202, 72/39, 40, 43, 236

[56] References Cited

U.S. PATENT DOCUMENTS 4,392,367 7/1983 Bald ..... 72/201
4,741,193 5/1988 Kimura et al. ..... 72/201
5,517,842 5/1996 Ginzburg ..... 72/201
6,006,574 12/1999 Armenat et al. ..... 72/201

FOREIGN PATENT DOCUMENTS 3616070 12/1990 Germany .
3927276 2/1991 Germany .

*Primary Examiner*—Rodney A. Butler
*Attorney, Agent, or Firm*—Friedrich Kueffner

[57] ABSTRACT

A method and apparatus for cooling hot-rolled rolling stock, wherein, for cooling preferably both sides of hot-rolled wide strip, a heat exchange is carried out between the rolling stock and the cooling medium by a pressurized water flow through a sequence of a pressure chamber and a convection chamber, and wherein the rolling stock is cooled by a targeted control of the intensity of the forced convection. The method utilizes a combination of a cooling unit between stands and an additional roll cooling unit in the area of the roll gap at the exit side thereof using a directed pressurized water flow along a circumferential portion of the roll body of each work roll, wherein the cooling unit between stands and the roll cooling unit each operate with contactless sealing means for the surface of the rolling stock and the surface of the roll body.

18 Claims, 2 Drawing Sheets

METHOD AND APPARATUS FOR COOLING HOT-ROLLED ROLLING STOCK, PARTICULARLY HOT-ROLLED WIDE STRIP

BACKGROUND OF THE INVENTION

1. Field of the Invention

The present invention relates to a method of cooling hot-rolled rolling stock, wherein, for cooling preferably both sides of hot-rolled wide strip, a heat exchange is carried out between the rolling stock and the cooling medium by means of a pressurized water flow through a sequence of a pressure chamber and a convection chamber, and wherein the rolling stock is cooled by a targeted control of the intensity of the forced convection.

The invention also relates to an apparatus for carrying out the method.

2. Description of the Related Art

The findings in connection with cooling of hot-rolled rolling stock are based on practical experiences gathered over many years. These experiences show that, for example, in the case of wire and rod steel, significantly higher cooling intensities are achieved in water cooling sections than in water cooling sections of wide strip hot rolling trains. In cooling sections for wire and rod steel, the heat transmission coefficients are, for example, about 20,000 to 40,000 $W/m^2K$, while heat transmission coefficients of about 800 to 1,500 $W/m_2K$, i.e., a cooling intensity which is lower about ten to fifteen times, are achieved in a laminar cooling section following the finishing stand for hot-rolled wide strip. This has the result that a significantly longer cooling section is required for the same temperature drop in the case of hot-rolled wide strip as compared to wire and rod steel.

Because of more recent technologies in rolling hot-rolled strip, particularly for forming a ferritic structure, intensive cooling is required particularly between the last stands of a rolling train in order to achieve lower final rolling temperatures with stand spacings which are not too large. in the case of rolling thin dimensions, in which the hot-rolled strip reel must be arranged closer to the finishing stand for avoiding unsteady running of the strip, water cooling sections with higher cooling intensities are also required.

DE 39 27 276 A1 discloses a method of hardening steel with liquid cooling media. As mentioned in DE 39 27 276 A1, when using the previously known methods of hardening steel by means of liquid cooling media, only a small hardening depth in relation to the border zone is achieved in the rods having small rod diameters. In contrast, the method according to DE 39 27 276 A1 not only makes possibly a significant increase of the hardening depth, but also makes possible in a particularly simple manner a complete through hardening particularly of rod-shaped load products having diameters of up to 70 mm by subjecting the rolled product of steel immediately after the rolling process to high flow velocities in a cooling section provided with cooling media. The flow velocities in the cooling section are advantageously so high that heat transmission coefficients are greater or equal to 50,000 $W/m^2K$ are produced and the rolling stock is cooled in the cooling section until the average temperature of the cross-section of the rolling stock is below the MS temperature, so that, after leaving the cooling section, the austenite which is still present in the core is converted into an intermediate structure (bainite) as a result of the temperature equalization across the cross-section, while simultaneously a large portion of the superimposed heat and conversion stresses are decreased in the martensitic border zone because the temperature once again increases up to the maximum MS temperature.

As is well known, for realizing comparatively low final rolling temperatures with stand spacings which are not too large, a cooling of the roll body surfaces which is as intensive as possible is required in addition to the use of water cooling sections between the individual stands.

The principal reason for roll cooling is that the roll may not exceed a certain temperature in order to maintain the strength of the roll surface and, thus, the service life of the roll. Another reason is the diameter tolerance of the roll which is only ensured when the roll temperature is constant.

In accordance with the prior art, a conventional roll cooling is carried out by spraying water from spray nozzles onto the roll. This requires large quantities of water in order to keep the low temperature level of a roll at 60 to 80° C. However, the removal of these quantities of water pose a significant problem because the water which flows off may be backed up and may prevent the liquid being supplied from unimpededly reaching the roll surface, so that the cooling effect is significantly reduced.

In order to eliminate this problem, DE 36 16 070 C2 proposes a so-called gap cooling system in which cooling water is fed through a feed opening arranged at the lower end of the cooling body into a cooling gap which partially surrounds the circumference of the roll body and is discharged out of the cooling gap through a discharge opening arranged at the upper end of the cooling body. This arrangement has the disadvantage that sealing of the cooling gap is effected by placing the cooling body of elastic material under pressure against the roll. This may lead to damage of the roll casing, for example, due to abrasion, so that markings on the rolled strip may be produced.

SUMMARY OF THE INVENTION

Therefore, starting from the prior art discussed above, it is the primary object of the present invention to further improve and develop a method of the type described above in such a way that a significantly increased cooling effect of the rolling stock is realized with the same length of the cooling section between two stands, or in which the length of the cooling section is significantly reduced with the cooling effect being the same.

Another object of the invention is to provide an apparatus for carrying out the method of the invention in a problem-free manner while avoiding the disadvantages and difficulties of the prior art.

In accordance with the present invention, the method of cooling hot-rolled rolling stock utilizes a combination of a cooling unit between stands and an additional roll cooling unit in the area of the roll gap at the exit side thereof using a directed pressurized water flow along a circumferential portion of the roll body of each work roll, wherein the cooling unit between stands and the roll cooling unit each operate with contactless sealing means for the surface of the rolling stock and the surface of the roll body.

In accordance with a further development of the invention, cooling of the hot-rolled rolling stock between the stands is carried out by mutually supplementing pressurized water flows in order to achieve an operational total cooling effect.

In accordance with the present invention, this is achieved by lowering the surface temperature of the rolling stock or of the hot-rolled strip in the roll gap by lowering the temperature of the roll body in such a way that the temperature in the subsequent cooling unit between the stands drops along the cooling section below the Leidenfrost temperature.

As a result of the combination of the two cooling methods into a functional unit according to the present invention, the total cooling effects for the strip as well as for the roll can be further increased because this combination provides the following advantages:

- cooling between the stands starts already in the area of the roll gap exit; because of the lowered surface temperature of the strip in the roll gap, the cooling effect of the subsequent cooling unit between the stands can be significantly intensified because the temperature now drops more quickly below the Leidenfrost temperature and, thus, the cooling effect is intensified;
- the heat near the surface of the roll is removed from the roll and cannot diffuse into the inner portions of the roll;
- when the spacing between stands remains equal, a better temperature equalization can be realized along the same cooling section length;
- with the spacing between stands being equal, it is now possible to increase the water section length with the equalization section being the same and, thus, to intensify the lowering of the temperature;
- both cooling systems can be equipped, for example, with a common water supply;
- contrary to conventional roll cooling by means of spray nozzles, a significantly higher level of heat transmissions can be achieved by the additional roll cooling unit using a directed and forced pressurized water flow along a circumferential portion of the roll body;
- because of the targeted return of water in the cooling body of the rolls, less water reaches the strip surface in an uncontrolled manner;
- in comparison to the conventional spray nozzle cooling of the rolls, a significantly higher cooling effect is achieved with a significantly lower quantity of cooling water;
- because of a significantly intensified heat transmission between the pressurized water flow along a circumferential portion of the roll body, it is only necessary to cool the roll on one side, which leads to a simplification of the stand structure.

In accordance with a further development of the method of the invention, the cooling system between the stands is connected directly to the roll cooling unit at the exit of the roll gap.

In accordance with another feature of the method of the present invention, the intensity of the forced convection and, thus, the cooling effect of the roll cooling unit, on the one hand, and the cooling unit between the stands, on the other hand, are adjusted independently of each other by individually adjustable parameters, such as, quantity, pressure and flow velocity of the cooling water flow.

In accordance with another advantageous feature, the roll cooling unit as well as the cooling unit between stands is fed from a common pressurized water source, but with independently adjustable pressure and quantity.

In accordance with another advantageous feature of the method, the cooling medium is supplied and discharged by means of contactless sealing means of its flow paths relative to the surfaces of the roll body and the rolling stock to be cooled.

Finally, an advantageous further development of the method provides that the cooling medium for the roll cooling of each roll is supplied from above and from below through a preferably adjustable nozzle gap along at least one cooling water duct resting against the roll body, the cooling medium is then conducted in a counter-current flow and is conducted at the discharge side into a diffusor and is conducted from the diffusor into a discharge space and is discharged from the discharge space in a controlled manner.

Because of the controlled discharge of the cooling water form the roll cooling unit, complicated devices and measures for collecting the discharged cooling water are avoided and, thus, the structures required for this purpose are significantly reduced.

The apparatus according to the present invention for the intensive cooling of hot-rolled rolling stock includes at least one cooling unit for cooling hot-rolled wide strip from both sides between two spaced-apart stands of a finishing train, with a pressure space and convection space of a flow duct constructed for providing a heat exchange between the rolling stock and the cooling medium by forced convection for forming a directed flow of the cooling medium and controlling the intensity of the forced convection in dependence on the flow velocity, combined with at least one cooling body arranged upstream of the rolling direction for cooling the work rolls of a roll stand arranged in front of the cooling unit, wherein the cooling body forms a gap to which cooling medium can be supplied under forced convection in the flow area between a cooling water supply and a cooling water discharge and the cooling units or the cooling body include contactless sealing means relative to the surfaces of the strip and roll to be cooled.

An advantageous further development of the apparatus provides that the gap preferably has at both ends a controllable supply for cooling medium so as to form two flow halves directed in opposite directions and is provided approximately in the middle thereof with a diffusor and this diffusor is connected to a collection space for cooling medium to be discharged.

For regulating the quantity of supplied cooling medium, each flow path can advantageously be provided with a throttling member in the form of an adjustable nozzle gap.

In accordance with a further development of the invention, the pressure space of the cooling unit at the entry side of the rolling stock includes an inlet for the cooling medium in the form of a nozzle gap for adjusting the quantity and pressure of the medium, and a diffusor at the end with means for discharging the cooling medium, wherein a retaining element defining the pressure space is arranged in the rolling direction in front of the diffusor, wherein the retaining element constitutes the beginning of the convection space. The retaining element is advantageously constructed so as to be adjustable longitudinally in the rolling direction so as to change the length of the pressure space and the convection space. The nozzle gap includes a wedge as an adjusting member.

An advantageous further development of the cooling unit provides that the diffusor has in the area of increased cooling medium pressure outlets for discharging the heated cooling medium. It is particularly advantageous that the cooling unit for cooling the rolls and the cooling unit for cooling the rolling stock are combined into a structural unit. For this purpose, the outlet of the cooling water at the roll cooling unit is closed, so that the cooling water of the roll cooling unit flows into the inlet funnel of the rolling stock cooling unit.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
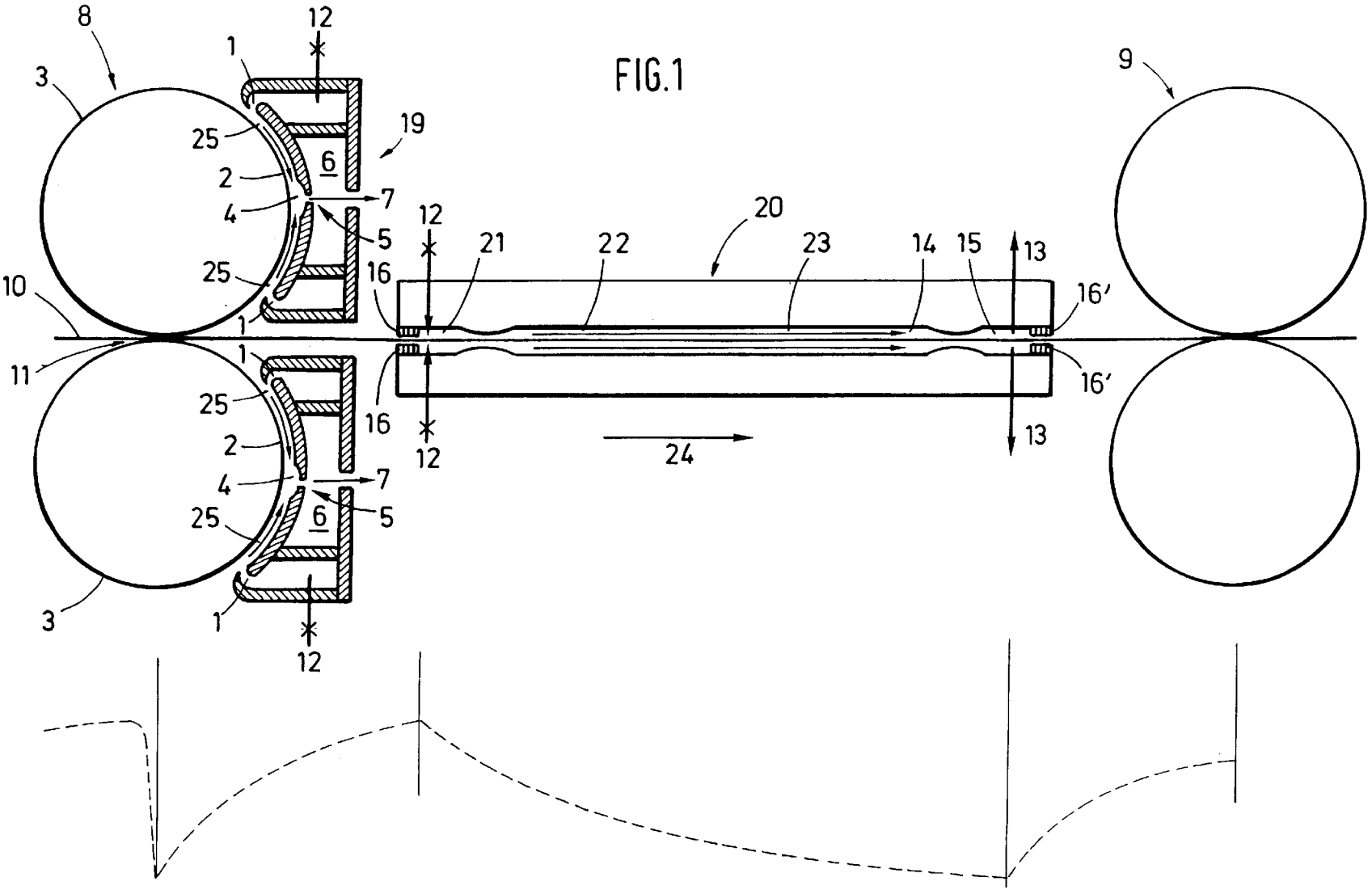
FIG. 1 is a schematic side view, partially in section, of an apparatus for cooling hot-rolled rolling stock according to the present invention.

FIG. 1 of the drawing shows the apparatus according to the present invention for cooling hot-rolled rolling stock or hot-rolled wide strip 10. For preferably cooling both sides of hot-rolled wide strip between two spaced-apart stands 8, 9, a heat exchange is carried out between the hot-rolled wide strip 10 and cooling medium by means of a forced pressurized water flow 14 between a water supply 12 and a water discharge 13 through a sequence of a pressure space 21 and a convection space 22, and the rolling stock 10 is cooled by a targeted control of the intensity of the forced convection which occurs in dependence on the flow velocity. Reference numeral 15 denotes a diffusor at the end of the cooling section, wherein used cooling water is discharged from the diffusor through a water discharge 13. In accordance with the present invention, in addition to the cooling units 20 between the stands, an additional roll cooling unit 19 is provided in the area of the exit of the roll gap 11, wherein the additional roll cooling unit 19 uses a directed and forced pressure water flow 25 along a circumferential portion of the roll body 2 of each work roll 3.

The combination of the strip cooling unit 20 between the stands 8 and 9 and an intensive roll cooling 19 with two pressurized water flows 25 which supplement each other to produce a forced convection results in an optimized functional unit with a substantially increased total cooling effect.

The temperature curve shown in the drawing in broken lines corresponding to the two cooling units 19 and 20 shows that the surface temperature of the rolled strip initially sharply drops in the roll gap 11 and then once again increases as a result of the core heat of the strip (temperature equalization) until the rolled strip 10 enters the cooling unit 20 and, after entering the cooling unit 20, the temperature gradually decreases until it once again slowly increases due to temperature equalization after emerging form the cooling unit 20.

The advantages of the combination of the cooling methods is particularly apparent from the fact that the rolling stock cooling unit 20 is directly connected to the roll cooling unit 19 at the exit of the roll gap 11.

FIG. 1 further shows that at least the water inlets 12 of the cooling section 20 and the water inlets 12' of the roll cooling unit 19 may be equipped with a—symbolically indicated—throttling member. This makes it possible to control the intensity of the forced convection and, thus, the cooling effect of the roll cooling unit 19, on the one hand, and of the rolling stock cooling unit 20, on the other hand, independently of each other by individually adjustable parameters, such as, quantity, pressure and slow velocity of the cooling water flow. The roll cooling unit 19 as well as the rolling stock cooling unit 20 may be supplied from a common pressurized water source, but with independently adjustable pressure and quantity.

The cooling media are conducted by means of contactless sealing means for the flow paths, for example, at the cooling unit 20 by labyrinth-type seals 16, 16' arranged at the ends, and in the cooling body 19 by flow-technological measures in the area of the nozzle gaps 1.

For example, the cooling medium for the roll cooling unit 19 of each work roll 3 is fed in under pressure from the top and from the bottom through an adjustable nozzle gap 1 each along a cooling water duct 25 resting against the roll body 2, is conducted in a counter-current flow and is conducted at the exit side into a diffusor 4 from which used cooling medium 7 is conducted through outlet openings 5 into a discharge space 6 and is removed from the discharge space 6 in a controlled manner,.

For removing the cooling medium, the cooling unit 20 has at the end of the flow ducts 23 a diffusor 15 from which used cooling medium is discharged through the water discharge 13.

Figure 2:
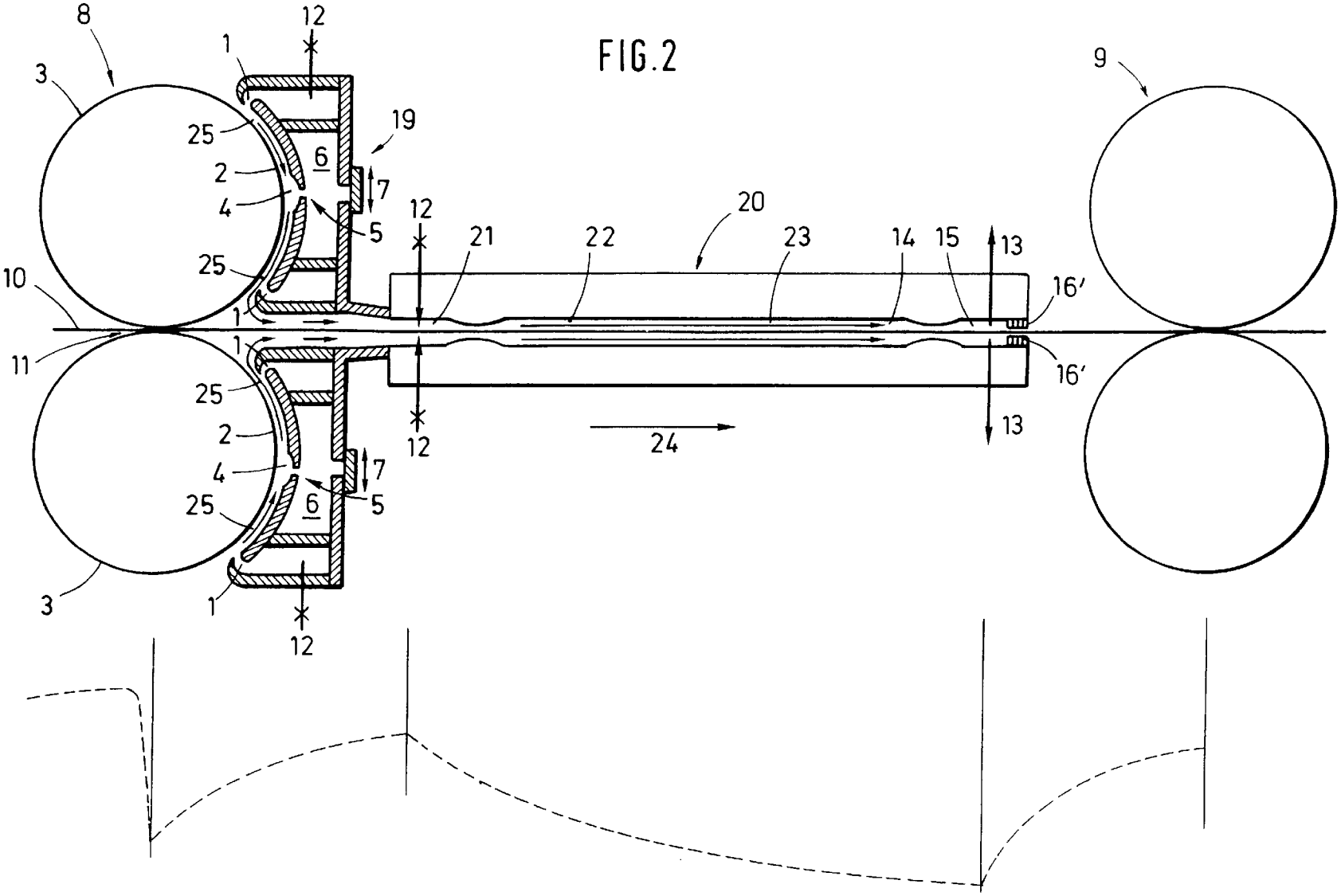
FIG. 2 is a schematic side view, partially in section, of another embodiment of the apparatus for cooling hot-rolled rolling stock according to the present invention.

FIG. 2 of the drawing shows another embodiment of the apparatus according to the present invention in which the cooling unit 20 and the cooling body 19 are combined into a structural unit. Cooling water enters the cooling body 19 at 12' and flows along the roll body 2 onto the hot-rolled wide strip 10 where the water is deflected and flows in a duct above and below the strip 10 into the cooling unit 20. Cooling of the hot-rolled wide strip 10 in the cooling unit 20 takes place in the same manner as explained with respect to FIG. 1.

The temperature curve shown in a broken line corresponding to the cooling body 19 and the cooling unit 20 is similar to the temperature curve shown in fig. 1, however, with the difference that the temperature of the strip increases due to its core heat to a relatively lesser extent before the gradual temperature drop takes place in the cooling unit 20.

While specific embodiments of the invention have been described in detail to illustrate the inventive principles, it will be understood that the invention may be embodied otherwise without departing from such principles.

We claim:

1. An apparatus for intensively cooling hot-rolled rolling stock comprising at least one cooling unit for cooling the rolling stock on both sides thereof between two spaced-apart roll stands of a finishing train, the at least one cooling unit comprising on each side of the strip a flow duct with a pressure chamber and a convection chamber for a heat exchange between the rolling stock and the cooling medium by a forced convection for forming a directed flow of the cooling medium and for controlling an intensity of the forced convection in dependence on a flow velocity, further comprising at least one cooling body for cooling the work rolls of a first of the roll stands in a rolling direction of the rolling stock, wherein each cooling body at one of the rolls of the first roll stand defines a gap to which the cooling medium can be supplied under forced convection in the flow area between a cooling water supply and a cooling water discharge, and wherein the at least one cooling unit and the cooling body each have contactless sealing means relative to the surfaces of the rolling stock and the roll to be cooled.

2. The apparatus according to claim 1, wherein the gap has at both ends thereof a controllable supply for cooling medium so as to form two oppositely directed flow paths, wherein the gap defines approximately in the middle thereof a diffusor, and wherein the diffusor comprises a collecting chamber for cooling medium to be discharged.

3. The apparatus according to claim 1, wherein the pressure space of the at least one cooling unit has at an entry side of the rolling stock an inlet for the cooling medium in the form of a nozzle gap adjustable with respect to quantity and pressure, and a diffusor at a downstream end of the at least one cooling unit provided with means for withdrawing the cooling medium, and a back-up element defining the pressure chamber arranged in front of the diffusor in the rolling direction, wherein the back-up element constitutes the beginning of the convection space.

4. The apparatus according to claim 1, wherein the at least cooling unit and the cooling body are combined into a structural unit.

5. The apparatus according to claim 2, wherein each flow path comprises a throttling member in the form of an adjustable nozzle gap for controlling a quantity of supplied cooling medium.

6. The apparatus according to claim 3, wherein the back-up element is longitudinally adjustable for changing a length of the pressure chamber and the convection chamber in the rolling direction.

7. The apparatus according to claim 3, wherein the nozzle gap comprises a wedge as adjusting member.

8. The apparatus according to claim 3, wherein the diffusor has outlets in an area of increased cooling medium pressures for removing heated cooling medium.

9. A method of cooling hot-rolled rolling stock, comprising carrying out a step of cooling the rolling stock between two spaced-apart roll stands by effecting a heat exchange between the rolling stock and a cooling medium using a pressurized water flow through a sequence of a pressure chamber and a convection chamber and cooling the rolling stock by a targeted control of an intensity of a resulting forced convection, further comprising combining the step of cooling between stands with an additional step of roll cooling in an area of a roll gap on an exit side thereof utilizing a directed pressurized water flow along a circumferential portion of a roll body of each work roll, and operating the step of cooling between stands and the roll cooling each which contactless seals relative to a rolling stock surface and a roll body.

10. The method according to claim 9, comprising cooling both sides of hot-rolled wide strip.

11. The method according to claim 9, comprising carrying out the step of cooling the hot-rolled rolling stock between the stands and the roll cooling with mutually supplemental pressurized water flows for achieving an operational total cooling effect.

12. The method according to claim 9, comprising lowering a surface temperature of the rolling stock in the roll gap by lowering the roll body temperature, such that the surface temperature is near or below the Leidenfrost temperature of the cooling medium when the rolling stock enters the step of cooling between stands, whereby the cooling effect in the cooling step between stands is increased.

13. The method according to claim 9, comprising carrying out the step of cooling between stands immediately following the roll cooling at the exit of the roll gap.

14. The method according to claim 9, comprising controlling an intensity of the forced convection and the cooling effect of the step of roll cooling and of the step of cooling between stands independently of each other by individually adjustable parameters.

15. The method according to claim 9, comprising feeding the cooling medium for the step of roll cooling and the step of cooling between stands from a common pressurized water source, but with independently adjustable pressures and quantities.

16. The method according to claim 9, comprising supplying and discharging in a targeted manner the cooling medium using contactless sealing means of flow paths thereof relative to the surfaces to be cooled of the roll bodies or the rolling stock.

17. The method according to claim 14, wherein the individually adjustable parameters are quantity, pressure and flow velocity of the cooling water flow.

18. The method according to claim 16, comprising supplying the cooling medium for the roll cooling of each roll through an adjustable nozzle gap from above and from below along at least one cooling water duct in contact with the roll body, conducting the cooling medium in a countercurrent flow and conducting the cooling medium at an outlet into a diffusor, conducting the cooling medium from the diffusor into a discharge space and discharging the cooling medium from the discharge space in a controlled manner.

* * * * *